US006424311B1

(12) United States Patent
Tsai et al.

(10) Patent No.: US 6,424,311 B1
(45) Date of Patent: Jul. 23, 2002

(54) DUAL-FED COUPLED STRIPLINE PCB DIPOLE ANTENNA

(75) Inventors: Szu-Nan Tsai; Hsiang-Hui Shen; Hsin Kuo Dai; Kun Te Cheng; Hsien Chu Lin; Chieh-Chao Yu; Chih-Kai Huang, all of Tu-Chen (TW)

(73) Assignee: Hon Ia Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/814,080

(22) Filed: Mar. 20, 2001

(30) Foreign Application Priority Data

Dec. 30, 2000 (TW) ..... 89128438

(51) Int. Cl.[7] ..... H01Q 9/28
(52) U.S. Cl. ..... 343/795; 343/806
(58) Field of Search ..... 343/795, 793, 343/806, 807, 700 MS, 726

(56) References Cited

U.S. PATENT DOCUMENTS 5,293,175 A * 3/1994 Hemmie et al. ..... 343/795

5,719,586 A * 2/1998 Tuttle ..... 343/726

* cited by examiner

*Primary Examiner*—Don Wong
*Assistant Examiner*—James Clinger
(74) *Attorney, Agent, or Firm*—Wei Te Chung

(57) ABSTRACT

A dipole antenna for selecting an antenna polarization plane of the strongest polarization energy includes at least two dipole antenna elements (1, 2) arranged perpendicularly to each other to form a single antenna, a PCB (3), and two feeding lines (4). Each dipole antenna element includes two T-shaped dipole arms (11, 12). This structure makes use of two planes of the XZ-plane, XY-plane and YZ-plane, and also makes the dipole antenna more compact. The antenna obtains optimum polarization energy by selecting the strongest energy plane. This achieves maximized radiation efficiency under any particular orientation of the dipole antenna. The strongest energy plane is selected by controlled switching, by means of dual-fed signal mode. The dipole arms of each dipole antenna element are disposed on opposite surfaces (31, 32) of the PCB, to minimize interference.

15 Claims, 3 Drawing Sheets

| 1:Mkr (MHz) | | 2:Mkr (MHz) dB |
|---|---|---|
| A: 2400.0000 | 1.788 | |
| B: 2450.0000 | 1.770 | |
| C> 2500.0000 | 1.853 | |

DUAL-FED COUPLED STRIPLINE PCB DIPOLE ANTENNA

BACKGROUND OF THE INVENTION

1. Field of the Invention

The present invention relates in general to wireless communication systems and components, and in particular to a printed circuit board configured dual-fed coupled stripline PCB dipole antenna.

2. Description of the Related Art

Communication system designers are constantly seeking ways to improve the performance of system components and signal processing circuits, but without substantially increasing complexity of hardware or costs. For example, designers always want received and transmitted signals to be stronger. Almost all conventional antennas have had either only one plane (XZ-plane or YZ-plane or XY-plane) with significant polarization energy, or a complicated or excessively large structure.

A conventional sleeve antenna comprises a radiation element having an electrical length of one quarter wavelength, a sleeve having an electrical length of one quarter wavelength, and a coaxial cable for feeding electric power to the radiation element. An outer conductor of the coaxial cable is connected to the sleeve, while an inner conductor of the coaxial cable is connected to the radiation element.

A conventional inverted coaxial dipole antenna has a central conductor of a coaxial cable connected via a feeding line to a sleeve, wherein the feeding line is extended through a slot which is formed in an outer tube of the antenna.

A conventional stripline antenna is shown in FIG. 4. The antenna comprises a coupler 70, a radiation element 72 spaced apart from but adjacent the coupler 70 and serving as an antenna element, a dielectric substrate 75 on which the antenna element is disposed, a ground plane 74 under the dielectric substrate 75, a feed point 71 on the coupler 70, and a short point 73 disposed on the radiation element 72 and shorted to the ground plane 74.

Conventional antennas such as those described above have a number of disadvantages.

Conventional sleeve antennas and inverted coaxial dipole antennas involve complicated fabrication and adjustment, because the feeding coaxial cable is connected to the sleeve. This makes quality control in manufacturing difficult.

Stripline or microstrip antennas can solve the above problems associated with conventional sleeve antennas and inverted coaxial dipole antennas. However, the polarization energy of stripline or microstrip antennas is significant in only one plane (XZ-plane or YZ-plane or XY-plane), and is minimal or even faded in the other two planes. Additionally, the intensity of the utilized polarization energy changes with the orientation of the antenna. Thus optimum radiation efficiency may not be always achieved. For documentation that describes and illustrates conventional antennas, attention is directed to U.S. Pat. No. 4,069,483 and Taiwan Patent Application No. 87112281.

U.S. Pat. No. 4,833,482 discloses a circularly polarized microstrip antenna array which comprises two independent linearly polarized arrays. The first and second antenna arrays are fed with two independent signals about 90 degrees apart, and independently radiate a horizontally linearly polarized wave and a vertically linearly polarized wave respectively. Far afield, these waves become a circularly polarized wave. Each antenna array also has a plurality of stripline conductors having a plurality of radiation elements protruding outwardly therefrom in a direction of about 45 degrees from the stripline conductors. This antenna arrangement, however, is difficult to manufacture and increases production costs. Moreover, the stripline conductors disposed adjacent each other cause mutual interference, which reduces radiation efficiency. The copending application with an unknown serial number filed Mar. 5, 2001 with the title "STRIPLINE PCB DIPOLE ANTENNA" having the same inventors and the same assignee with the instant application, discloses one approach to improve the aforementioned shortcomings.

SUMMARY OF THE INVENTION

A preferred embodiment of the present invention provides two dipole antenna elements that are arranged perpendicularly to each other to form a single antenna, a PCB on which the two dipole antenna elements are disposed, and two feeding lines connected with the two dipole antenna elements respectively. This perpendicular arrangement makes use of two planes of the XZ-plane, XY-plane and YZ-plane. The antenna obtains optimum polarization energy by selecting the strongest energy plane. This achieves maximized radiation efficiency under any particular orientation of the antenna. The strongest energy plane is selected by controlled switching, by means of dual-fed signal mode.

In order to effectively minimize interference, two T-shaped dipole arms of each dipole antenna element are disposed on opposite surfaces of the PCB. Such T-shaped configurations also make the antenna more compact.

DETAILED DESCRIPTION

As indicated in the above description of the related art, conventional antennas often neglect two of the three polarization energy planes. It has been found that improved performance is achieved by providing two dipole antenna elements perpendicular to each other, as detailed below.

Figure 1:
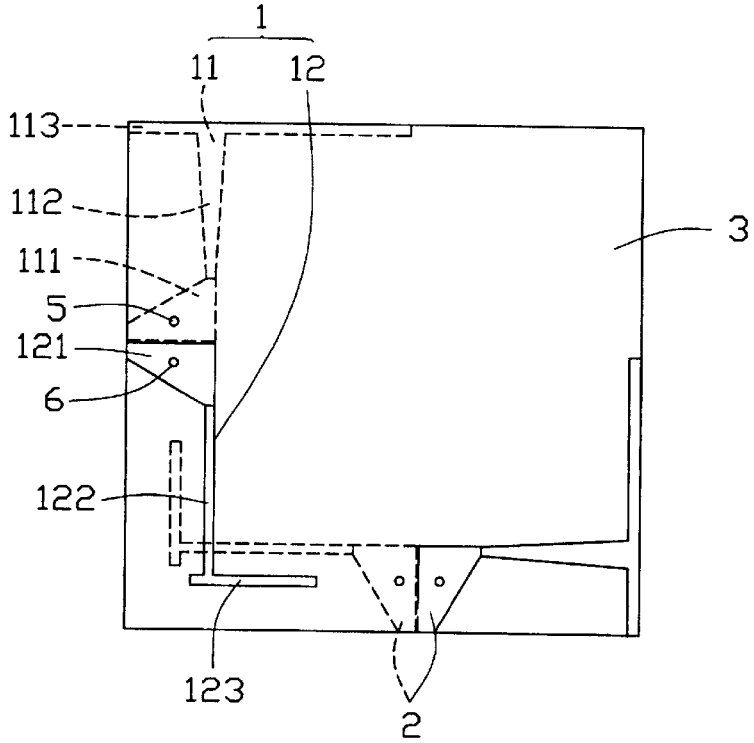
FIG. 1 is a top plan view of a dual-fed coupled stripline PCB dipole antenna in accordance with the present invention.
Figure 2:
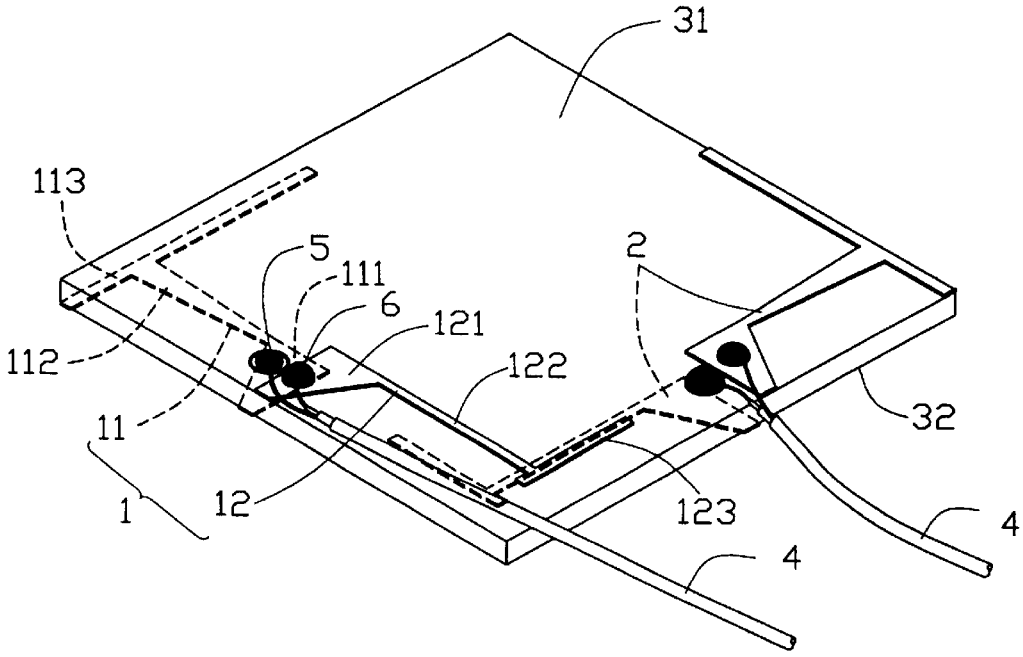
FIG. 2 is a perspective view of the antenna of FIG. 1.

Referring to FIGS. 1 and 2, a dipole antenna of the present invention comprises two dipole antenna elements 1, 2 which are substantially the same as each other, a generally square PCB 3, and two feeding lines 4 which comprise coaxial electric cables.

Since both dipole antenna elements 1, 2 are essentially the same, only the dipole antenna element 1 will be described in detail. The dipole antenna element 2 will be described only briefly. The dipole antenna element 1 is made from copper cladding, and comprises first and second dipole arms 11, 12. The first dipole arm 11 comprises a first head section 111, a first arm section 112, and a second arm section 113. Similarly, the second dipole arm 12 comprises a second head section 121, a third arm section 122 and a fourth arm section 123. The first and second head sections 111, 121 may be trapezoid, rectangular, triangular etc., and are aligned with each other and symmetrically opposite each other. In the preferred embodiment, the first and second head sections 111, 121 are generally trapezoid. The first and third arm sections 112, 122 respectively extend to the first and second head sections 111, 121, and serve as transmission sections of the dipole antenna element 1. The second and fourth arm sections 113, 123 are thin rectangular strips, and are perpendicular to and contact the first and third arm sections 112, 122, respectively. One of the second and fourth arm sections 113, 123 serves as a coupler shorted to the ground, and the other of the second and fourth arm sections 113, 123 serves as a radiation section of the dipole antenna element 1. First and second feed points 5, 6 are provided on the first and second head sections 111, 121, respectively.

The PCB 3 serves as a substrate, and has an upper surface 31 and a lower surface 32. Each feeding line 4 comprises an outer cylindrical conductor (not labeled), and a coaxial internal conductor (not labeled). The outer and inner conductors are connected with the first and second feed points 5, 6, respectively.

The first and second dipole arms 11, 12 are disposed on the lower surface 32 and the upper surface 31 of the PCB 3, respectively. A width of the first arm section 112 gradually increases from one end thereof to another end thereof. The first arm section 112 is wider than the third arm section 122. This configuration can broaden frequency band.

The dipole antenna element 2 is substantially the same in structure as the dipole antenna element 1. The dipole antenna elements 1, 2 are generally perpendicular to each other, and are arranged at two adjacent side portions of the PCB 3. Corresponding functional sections of the dipole antenna elements 1, 2 are perpendicular to each other, including the corresponding radiation sections. Thus the dipole elements 1, 2 independently radiate a horizontally linearly polarized wave and a vertically linearly polarized wave, respectively. Under any given orientation, the dipole antenna can measure the two polarization energy planes produced, compare the measurements, and then select the stronger of the two planes by controlling the feeding lines 4.

Figure 3:
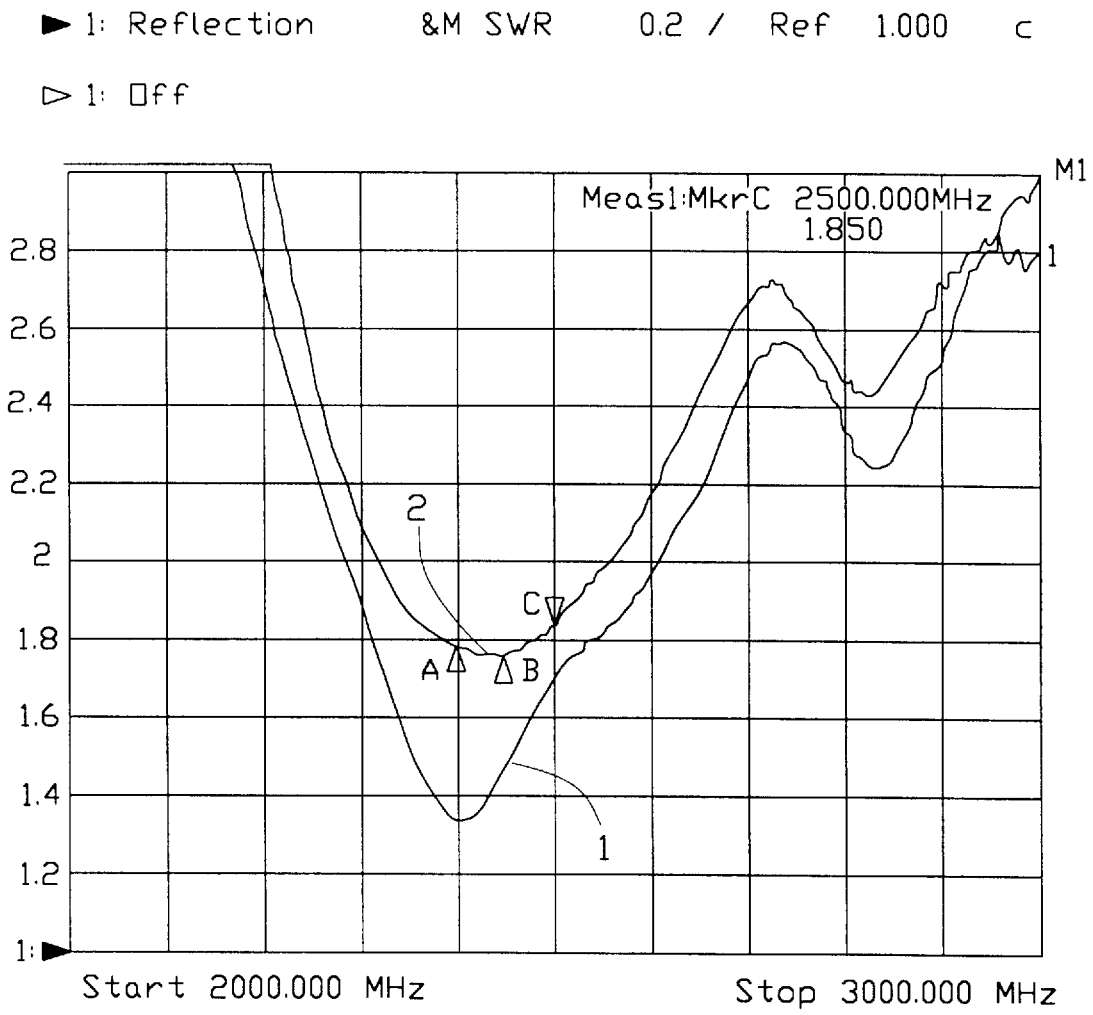
FIG. 3 is a graph of experimental results for the antenna of FIG. 1.
Figure 4:
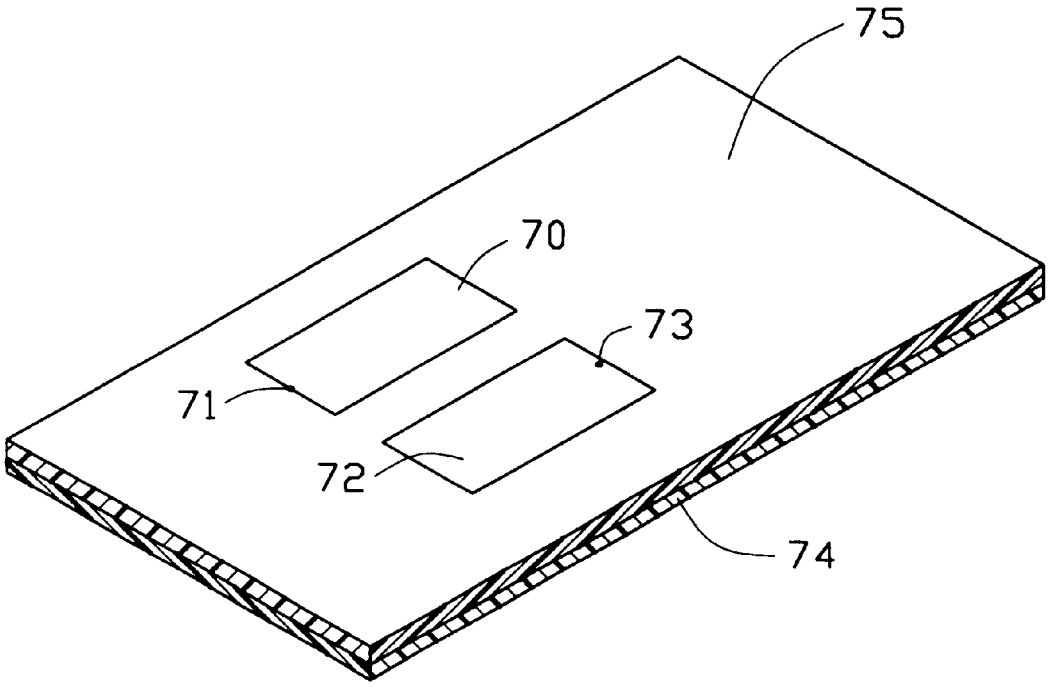
FIG. 4 (RELATED ART)
FIG. 4 is a perspective view of a section of a conventional antenna.

As is well known in the art, VSWR is one of the most important standards for measuring antenna characteristics. Prevailing industry standards require that VSWR be less than 2.0. As seen in FIG. 3, the dual-fed coupled stripline PCB dipole antenna of the present invention meets this requirement.

The VSWRs of the dipole antenna elements 1, 2 are both less than 2.0 in a frequency band ranging between 2.4 GHz and 2.5 GHz.

While an embodiment in accordance with the present invention has been shown and described, it is to be understood that the present invention is not limited to such embodiment. Numerous changes and modifications can be made to the present invention as known to persons skilled in the art, without departing from the spirit and scope of the present invention. The invention is therefore not to be limited to the details shown and described herein, but is intended to cover all such changes and modifications as are obvious to persons of ordinary skill in the art.

We claim:

1. A dipole antenna comprising:

two dipole antenna elements disposed perpendicular to each other, each dipole antenna element having a first dipole arm and a second dipole arm;

two feeding lines connected with the two dipole antenna elements, respectively; and a PCB, wherein the first and the second dipole arms of at least one dipole antenna element are disposed on opposite surfaces of the PCB.

2. A dipole antenna claimed in claim 1, wherein each first dipole arm comprises a first head section having a feed point connected to one of the two feeding lines, a first arm section, and a second arm section generally perpendicular to the first arm section, the first arm section being interconnected between the first head section and the second arm section.

3. A dipole antenna as claimed in claim 1, wherein each second dipole arm comprises a second head section having a feeding point connected to one of the two feeding lines, a third arm section, and a fourth arm section generally perpendicular to the third arm section, the third arm section being interconnected between the second head section and the fourth arm section.

4. A dipole antenna as claimed in claim 2, wherein a width of the first arm section at one end thereof which is connected with the second arm section is greater than a width at any other portion of the first arm section.

5. A method for selecting an antenna polarization plane with the strongest polarization energy, comprising the steps of:

supplying at least two dipole antenna elements, two feeding lines, and a PCB;

dividing the dipole antenna elements into two groups;

disposing the two groups of dipole antenna elements perpendicular to each other on the PCB;

connecting the two feeding lines to the two groups, respectively; measuring a polarization energy intensity of each group of dipole antenna elements;

comparing respective polarization energy intensities of the two groups of dipole antenna elements; and selecting the group of dipole antenna elements having a stronger polarization energy intensity.

6. A method as claimed in claim 5, wherein each dipole antenna element comprises a first dipole arm and a second dipole arm.

7. A method as claimed in claim 6, wherein each first dipole arm comprises a first head section, a first arm section, and a second arm section generally perpendicular to the first arm section, the first arm section interconnecting the first head section and the second arm section.

8. A method as claimed in claim 6, wherein each second dipole arm comprises a second head section, a third arm section, and a fourth arm section generally perpendicular to the third arm section, the third arm section interconnecting the second head section and the fourth arm section.

9. A dipole antenna comprising:

a printed circuit board defining two opposite surfaces thereon;

first and second dipole antenna elements applied unto the two opposite surfaces, said first dipole antenna element and said second dipole antenna element being configured to be generally symmetrically positioned, relative to each other, by two sides of a diagonal of said printed circuit board; and first and second feeding lines respectively connected to said first and second dipole antenna elements.

10. The dipole antenna as claimed in claim 9, wherein said first dipole antenna element and said second dipole antenna element respectively extend along two adjacent edge sections of said printed circuit board.

11.The dipole antenna as claimed in claim 9, wherein said first dipole antenna element and said second dipole antenna element are perpendicular to each other.

12. A dipole antenna comprising:

a printed circuit board defining two opposite surfaces thereon;

two dipole antenna elements applied unto the two opposite surfaces, each of said two dipole antenna elements including first and second dipole arms both extending along a same edge portion of said printed circuit board, a shape of said first dipole arm being different from that of said second dipole arm; and two feeding lines connected to the corresponding dipole antenna elements, respectively, each of said two feeding lines including signal and ground lines respectively connected to the corresponding first and second dipole arms; wherein a joint of the signal line and the corresponding first dipole arm and another joint of the ground line and the corresponding second dipole arm are located on the same one of said two opposite surfaces.

13. The dipole antenna as claimed in claim 12, wherein the first dipole arm and the second dipole arm are respectively disposed on said two opposite surfaces.

14. A dipole antenna comprising:

a printed circuit board defining opposite first and second surfaces thereon;

two dipole antenna elements applied unto said first and second surfaces, each of said two dipole antenna elements including first and second dipole arms; and two feeding lines connected to the corresponding dipole antenna elements, respectively, each of said two feeding lines including signal and ground lines respectively connected to the corresponding first and second dipole arms; wherein the first dipole arm of one of said two dipole antenna elements is disposed on the first surface and the second dipole arm of said one of said two dipole antenna elements is disposed on the second surface, while the first dipole arm of the other of said two dipole antenna elements is disposed on the second surface and the second dipole arm of the other of said two dipole antenna elements is disposed on the first surface.

15. The dipole antenna as claimed in claim 14, wherein the first and the second dipole arms are shaped different from each other.

* * * * *